United States Patent [19]

Degelmann

[11] Patent Number: 4,998,188

[45] Date of Patent: Mar. 5, 1991

[54] WALL MOUNTED LIGHTING FIXTURE

[76] Inventor: Paul G. Degelmann, Rt. 6, Box 167 Lakeshore Dr., Americus, Ga. 31709

[21] Appl. No.: 279,162

[22] Filed: Dec. 2, 1988

[51] Int. Cl.[5] ..... F21S 3/02

[52] U.S. Cl. ..... 362/147; 362/339; 362/332; 362/248; 362/225

[58] Field of Search ..... 362/147, 240, 241, 244, 362/245, 247, 248, 251, 339, 332, 309, 362, 368, 308, 217, 260, 223, 225; 52/28; 248/222.4, 207, 223, 223.1

[56] References Cited

U.S. PATENT DOCUMENTS

| | | | |
|---|---|---|---|
| 3,163,367 | 12/1964 | Bodian | 362/339 |
| 3,829,680 | 8/1974 | Jones | 362/339 |
| 4,035,632 | 7/1977 | Rayman | 40/578 |
| 4,045,665 | 8/1977 | Williams et al. | 362/223 |
| 4,404,619 | 9/1983 | Ferguson | 362/223 |
| 4,680,684 | 7/1987 | Wolber | 362/332 |

FOREIGN PATENT DOCUMENTS

| | | | |
|---|---|---|---|
| 685831 | 5/1964 | Canada | 362/225 |
| 3506030 | 8/1986 | Fed. Rep. of Germany | 362/217 |

*Primary Examiner*—Stephen F. Husar
*Assistant Examiner*—D. M. Cox
*Attorney, Agent, or Firm*—Kenyon & Kenyon

[57] ABSTRACT

The present invention provides an improved wall-mounted lighting unit for creating a visual environment which is conductive to general care lighting and which requires both good vertical lighting and good brightness control. The lighting unit utilizes a microbase prism design in a refractor which preferably forms a portion of the bottom surface of the housing to provide good horizontal illumination and internal linear optics for good vertical illumination of the subject as well as providing a high visual comfort index. The lighting unit also has a unique leveling feature which compensates for irregularities in the surface of the wall upon which it is mounted. Backlighting can be provided by the lighting unit using a series of apertures which increase the structural integrity of the unit and also simplify its manufacture.

1 Claim, 2 Drawing Sheets

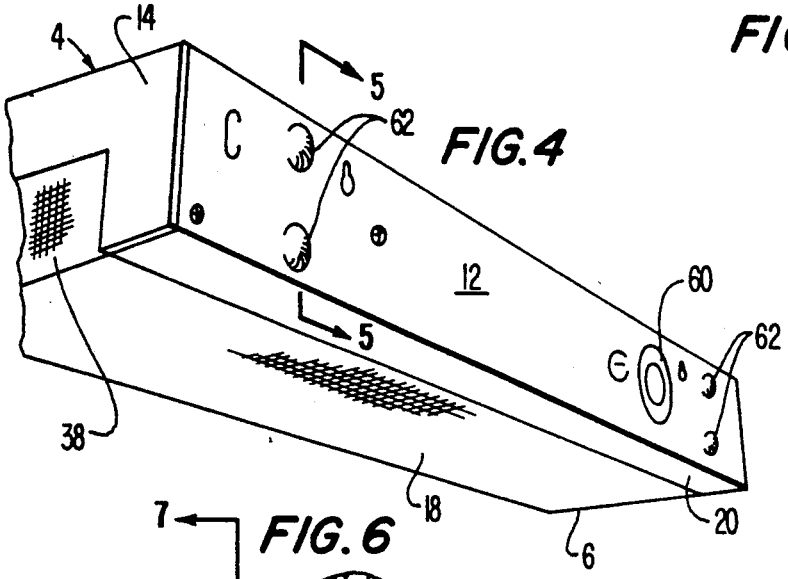
FIG. 4
FIG. 5
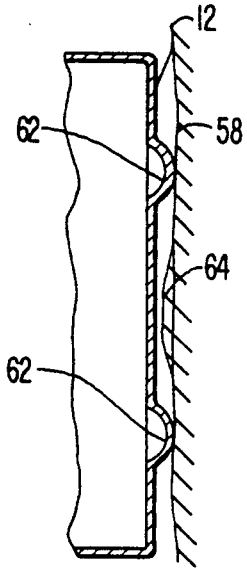
FIG. 6
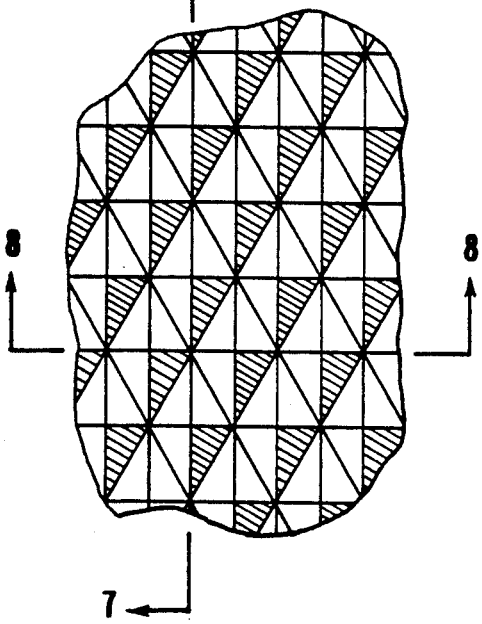
FIG. 7
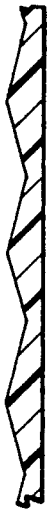
FIG. 8
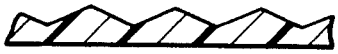
FIG. 9
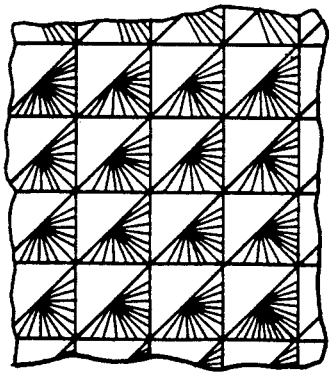
FIG. 10
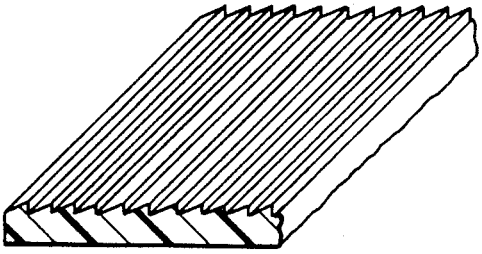

WALL MOUNTED LIGHTING FIXTURE

FIELD OF THE INVENTION

The present invention relates to wall-mounted lighting fixtures for creating a visual environment which is conducive to general care lighting. More particularly, it relates to wall-mounted lighting fixtures which provide good vertical and horizontal lighting.

BACKGROUND OF THE INVENTION

Wall-mounted lighting fixtures have been used for many years in environments where it is desirable to have good vertical lighting and brightness control. Such environments include condominiums, hotels, motels, commercial buildings, hospitals, nursing homes, stairwells, vanity areas and various other environments. These prior art lighting fixtures, however, have several disadvantages.

One disadvantage is the partial diffusion that occurs through the translucent refractor of the lighting unit. The refractor surface does not diffuse the light rays from the light source sufficiently enough to produce the optimal illumination and comfort. Moreover, these lighting units have the disadvantage that one is able to see the outline of the light source or lamp behind the refractor. This detracts from the overall aesthetic value and appeal of the unit. It would be desirable, therefore, to have a wall-mounted lighting fixture with a better refractor which provided for more diffusion of the light from the light source and wherein the light source itself was less visible to eye.

Another disadvantage arises when backlighting is provided using a wall-mounted lighting fixture. Typically, the backlighting is provided by cutting a large rectangular strip opening in the top surface of the lighting unit to allow light to be projected upwardly and outwardly. This slit opening is often covered with a refractor to provide for diffusion of the light rays from the light source as well as to keep the light source fully enclosed. The long rectangular slit, however, reduces the structural integrity of the lighting unit and complicates its manufacture and assembly. It would be desirable, therefore, to find a way to provide backlighting which does not decrease the structural integrity of the wall-mounted lighting unit and which simplifies its construction.

A third disadvantage with present wall-mounted lighting fixtures is their inability to adapt and conform to irregularities in the surface of the wall upon which they are mounted. These lighting fixtures are often two to four feet in length and thus span a good portion of the wall upon which they are mounted. Often there are irregularities in the surface of the wall over this distance. When one tries to mount these lighting fixtures on the wall, minor bumps and depressions in the wall's surface which normally would go unnoticed suddenly cause a problem due to the length of the lighting fixture. For example, if a bump occurs in the wall at the center of the lighting fixture where it is attached, the two ends of the lighting fixture are free to pivot about the bump and strike the wall. This is an unstable and undesirable situation, especially from an aesthetic viewpoint. It would desirable, therefore, to devise a lighting unit which was easily attachable to the wall and which did not have this problem.

SUMMARY OF THE INVENTION

Generally, the present invention provides an improved wall-mounted lighting unit or fixture which utilizes at least one translucent microbase prism refractor, provides apertured backlighting and/or has a leveling feature to overcome the problems identified above. Each particular feature or element addresses one of the problems discussed above and each wall bracket lighting fixture or unit can incorporate any combination of these features. Preferably all three features are incorporated into each unit.

The lighting unit is comprised of a housing with a light source mounted therein, a plurality of refractors or luminous elements forming a portion of the housing wherein at least one of the refractors utilizes a microbase prism design for controlling light from the light source to provide improved horizontal lighting and visual comfort. This microbase prism refractor provides a low brightness effect making the lighting unit more comfortable to the eye and also reduces lamp images to a minimum. Preferably, the microbase prism refractor forms a portion of the bottom surface of the housing. The side of the housing opposite from the wall is also a refractor incorporating linear prisms for light control. Preferably, the refractor forming a portion of the bottom surface of the housing is formed integrally with the refractor forming the front side of the housing, i.e. the side opposite from the wall, such that the refractors can be easily slid into and out of position as a unit to provide easy access to the light source mounted inside the housing. Additionally, refractors may form portions of the ends of the housing to increase the area illuminated by the lighting unit. This wraparound design provides good vertical illumination.

A plurality of apertures can be provided in the upper surface of the housing to provide backlighting. Preferably, the apertures are aligned in a row directly over a light source. This configuration provides better structural integrity in the lighting unit due to the webs of material located between the apertures. It also provides for easier manufacturing and assembly of the lighting unit due to the unitized construction possible with the apertured backlighting.

On the back side of the housing, i.e. the side of the housing located adjacent to the wall, a plurality of embossments are provided for leveling. These embossments are raised above the surface of the back side and slightly offset the lighting unit from the wall upon which it is mounted. The embossments enable the lighting unit to accommodate slight irregularities in the surface of the wall, thereby providing for a more stable and aesthetic unit.

Other details, objects and advantages of the present invention will become more readily apparent from the following description of presently preferred embodiments thereof.

BRIEF DESCRIPTION OF THE INVENTION

In the accompanying drawings, preferred embodiments of the present invention are illustrated, by way of example only, wherein:

FIG. 4 shows the back side of the lighting unit of FIG. 2;

FIG. 5 is an end view of the back of the lighting unit taken along line 5—5 of FIG. 4;

FIG. 6 is a close up showing the structure of a microbase prism refractor;

FIG. 7 is a side view of the microbase prism refractor taken along line 7—7 of FIG. 6;

FIG. 8 is a side view of the microbase prism refractor taken along line 8—8 of FIG. 6;

FIG. 9 is a close-up showing the structure of a prior art refractor; and

FIG. 1O is a close-up showing the structure of prior art refractor.

DESCRIPTION OF THE PREFERRED EMBODIMENTS

Figure 1:
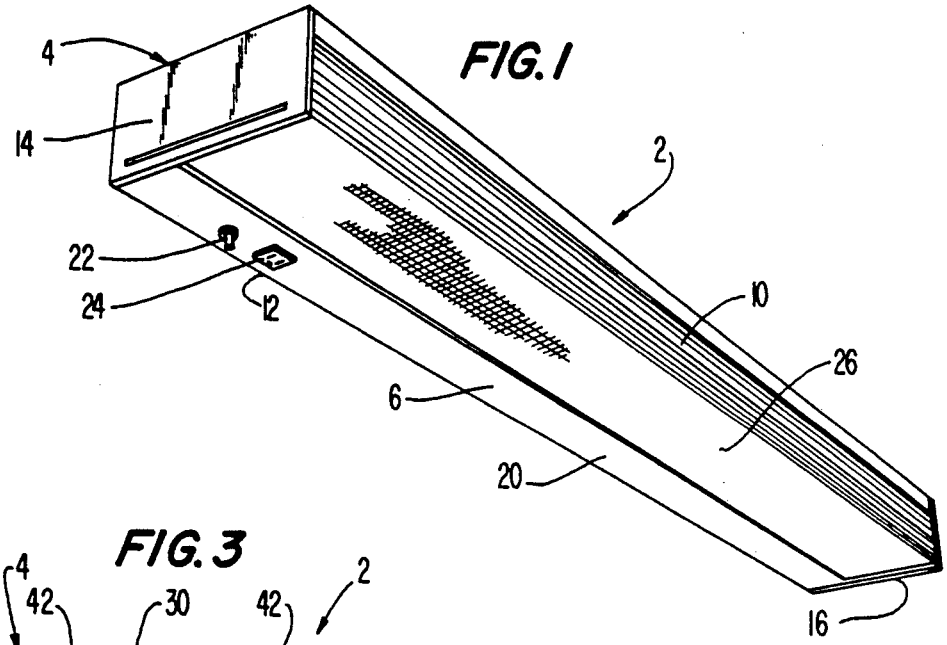
FIG. 1 is an isometric view from below of a wall-mounted lighting unit of the present invention.
Figure 2:
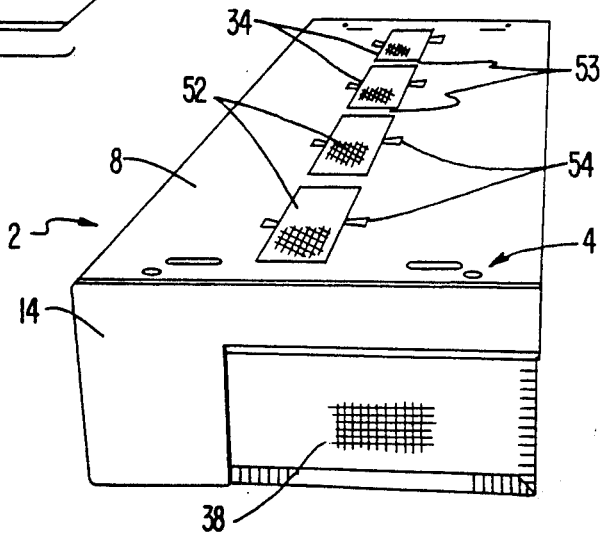
FIG. 2 is an isometric view from above of another embodiment of a wall-mounted lighting unit of the present invention.

FIG. 1 shows one embodiment of the wall-mounted lighting unit of the present invention. FIG. 2 shows another embodiment, one where a refractor forms part of the ends of the lighting unit to permit a greater area to be illuminated. Preferably, these lighting units are rectangular in shape, being about three inches thick, six inches wide and between two and four feet long. While these are the preferred dimensions and shape, many other dimensions and shapes could also be used. More specific information on these two embodiments is contained in the Metalux product specification sheets for the BE steel wall bracket and the BI steel wall bracket which are incorporated herein by reference as if fully set forth.

The lighting unit 2 comprises a rectangular housing 4 which has six sides or surfaces: a bottom surface 6, a top surface 8, a front side 1O, a back side 12 and two ends 14 and 16. Preferably, the bottom surface 8 is formed in part by a refractor 18 and a metal portion 20. The housing 4 is made of refractors and metal with the metal part being die formed in a single piece configuration from prime cold rolled steel. The top surface 8 of the housing 4 can be seen more clearly in FIG. 2. Preferably, the top surface 8, the back side 12 and the nonrefractor portions of the front side 10 and the bottom surface 6 are made of metal for increased structural integrity. Also located on the bottom surface 8 for easy access is a switch 22 to activate the lighting unit 2 as well as a receptacle 24 to which external devices may be connected to receive power.

Figure 3:
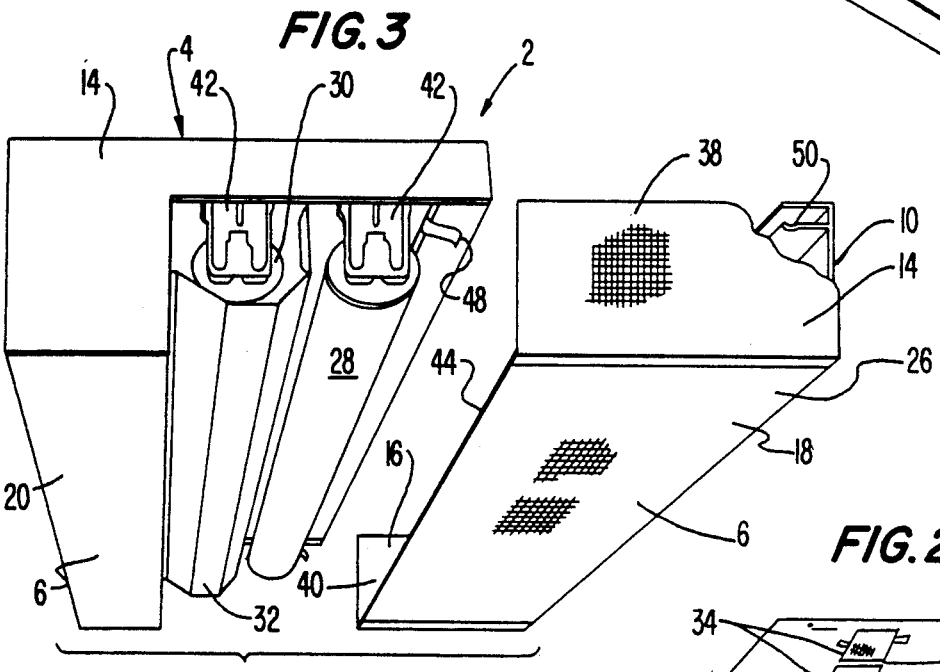
FIG. 3 is an isometric view from below of the lighting unit of FIG. 2 showing the refractors detached.

FIG. 3 shows the lighting unit 2 of FIG. 2 with the refractor unit 26 removed to provide easy access to the light source which preferably is two fluorescent lamps 28 and 30. The fluorescent lamp 30 is used to provide the backlighting and is isolated from lamp 28 by shield 32. Preferably, shield 32 has a reflective coating on its inside surface to help direct light upwardly through the apertures 34 in the top surface 8 of the lighting unit 2. Refractor unit 26 preferably is made up of a plurality of refractors comprising a horizontal refractor 18 and a vertical refractor 36 and may also include two end refractors 38 and 40. The refractor unit 26 shown in FIG. 1 only has a horizontal refractor 18 and a vertical refractor 36 while the refractor unit 26 shown in FIGS. 2 and 3 includes two end refractors 38 and 40. By using refractors at its ends, the lighting unit 2 is able to provide luminous ends increasing the lateral distribution of light and thereby illuminate a greater area. The other portion of ends 14 and 16 is an injection molded plastic piece which provides a decorative finishing touch to the lighting unit.

As shown in FIG. 3, the fixtures 42 for the lamps 28 and 30 are the standard mounts and connectors used in the lighting industry. Refractor unit 26 preferably slides between the two ends 14 and 16, and is supported on its leading edge 44 by edge 46 of the housing 4. The refractor unit 26 is also held in place by a pair of clips 48 which snap over the projections 50 from the back of the front surface of the refractor unit 26.

FIG. 2 shows the apertured backlighting arrangement wherein a plurality of apertures 34 are cut in the upper surface 8 of the lighting unit 2. Preferably, the apertures 34 are aligned over lamp 30 and have a refractor 52 located adjacent thereto. The refractor 52 may be a single refractor or a series of refractors which are held in place by integral clips 54. By using apertures 34 with web material 56 located therebetween, the lighting unit 2 has a unitized construction and can be manufactured and assembled more easily. This configuration also increases the structural integrity of the lighting unit 2 since the metal part is made from one piece of material. Refractors 52, in addition to controlling and diffusing light, serve as a dust shield.

FIG. 4 shows the back side 12 of the lighting unit 2 which is placed adjacent to the wall 58. A knockout 60 is provided in the back side 12 for easy access to the electrical wiring in the lighting unit 2 so that power can be provided from a socket in the wall. Additionally, a plurality of embossments 62 are provided on the back side 12 of the lighting unit 2 to raise the unit away from the wall 58. This can be more clearly seen in FIG. 5 which shows the lighting unit and embossments 62 placed against the surface of the wall 58. As shown in FIG. 5, the wall has an irregularity, namely bump 64. Without the embossments 62, the lighting unit would rest against bump 62 and would pivot thereupon. However, as shown in FIG. 5, bump 62 does not present any problem when mounting the lighting unit 2 because the embossments 62 raise the lighting unit 2 away from the wall 58 by a distance sufficient enough that minor irregularities such as bump 64 do not present a problem. Another advantage provided by embossments 62 is that the back side 12 of lighting unit 2 does not have to be flush with the wall. As a result, screws and other connections to the back side 12 do not have to be recessed below the surface. This also simplifies manufacturing and assembly.

FIG. 6 shows a close-up of the microbase prism design for the optical lens which is utilized in at least one of the refractor elements of the present invention. This structure can be compared with FIGS. 9 and 10 which show embodiments of currently used designs of refractors. FIG. 9 shows a conical structure located on a square base while FIG. 1O shows a ribbed structure. The microbase prism design is made by using a series of diamond-shaped pyramids placed adjacent to one another. This can be seen in FIGS. 7 and 8 which show side views of the microbase prism structure shown in FIG. 6. Alternatively, the pyramid could be placed on a square base rather than a diamond shaped base. Preferably the microbase prism is made of acrylic and has a size of about 0.125 $in^2$. This optical lens can be made in a variety of ways including by extrusion or by injection molding.

The microbase prism design provides for a greater control of the light and thereby increases the amount of illumination throughout the viewing area. The greater control increases the aesthetic value of the lighting unit because it prevents the outline of the light source from being detected when viewing the lighting unit. It also provides increased comfort to the viewer by decreasing the amount of direct light into the viewers' eyes.

Preferably, some of the refractors in the present invention utilize the microbase prism design. The best results are obtained if refractor 18 on the bottom surface 6 uses the microbase prism design. The other refractors 36, 38, and 40 can use a conical design (38 and 40, preferably) or a ribbed design (36 preferably) or they can utilize the microbase prism design if the situation requires.

While presently preferred embodiments of practicing the present invention have been shown and described with particularity in connection with the accompanying drawings, the invention may be otherwise embodied within the scope of the following claims. The scope of invention includes that which is defined in the claims and their equivalents. In this regard, the specification should not be interpreted to unduly limit the scope of the claims.

What is claimed:

1. An apparatus for providing light comprising:

(a) a housing of orthogonal configuration having an upper surface, a bottom surface, a front side, a rear side, a first end and a second end;

(b) said bottom surface being comprised substantially of a first refractor formed from a microbase prism;

(c) said upper surface having a series of apertures arranged in co-linear relationship, each of said apertures having a second refractor therein which is formed from a microbase prism, said apertures being separated by web material;

(d) said housing having fixtures for mounting a first and second fluorescent light source in spaced relationship substantially parallel to said bottom surface;

(e) a shield at least partially circumscribing said first light source for separating said first light source from said second light source;

(f) said fixtures for mounting said first light source located beneath said apertures;

(g) said shield having a portion thereof in opposed relationship to said apertures, with said portion including a reflective coating to redirect light toward said apertures;

(h) a plurality of embossments arranged on said rear side for leveling said housing on a mounting surface having irregularities; and (i) a portion of said front side, said first end, said second end, and said bottom surface comprising a refractor being formed integrally as a single unit, said single unit being releasably secured to said housing by a plurality of clips which engage projections from said single unit to permit access to a light source and fixtures mounted therein for replacement.

* * * * *